US011214409B2

(12) United States Patent
Rossi et al.

(10) Patent No.: US 11,214,409 B2
(45) Date of Patent: Jan. 4, 2022

(54) STOPPERS WITH OVERCAPS FOR CONTAINERS

(71) Applicant: Guala Closures S.p.A., Alessandria (IT)

(72) Inventors: Annalisa Rossi, Lu (IT); Luca Viale, Alessandria (IT)

(73) Assignee: GUALA CLOSURES S.P.A., Alessandria (IT)

( * ) Notice: Subject to any disclaimer, the term of this patent is extended or adjusted under 35 U.S.C. 154(b) by 0 days.

(21) Appl. No.: 16/606,396

(22) PCT Filed: Apr. 20, 2018

(86) PCT No.: PCT/IB2018/052769
§ 371 (c)(1),
(2) Date: Oct. 18, 2019

(87) PCT Pub. No.: WO2018/193422
PCT Pub. Date: Oct. 25, 2018

(65) Prior Publication Data

US 2021/0107704 A1 Apr. 15, 2021

(30) Foreign Application Priority Data

Apr. 21, 2017 (IT) ..... 102017000044485
Apr. 21, 2017 (IT) ..... 102017000044489

(51) Int. Cl.
*B65D 39/00* (2006.01)
*B65D 39/16* (2006.01)
*B65D 41/28* (2006.01)

(52) U.S. Cl.
CPC ..... *B65D 39/0052* (2013.01); *B65D 39/16* (2013.01); *B65D 41/28* (2013.01); *B65D 2251/0015* (2013.01)

(58) Field of Classification Search
CPC .... B65D 39/0052; B65D 39/16; B65D 41/28; B65D 2251/0015
(Continued)

(56) References Cited

U.S. PATENT DOCUMENTS 332,382 A * 12/1885 Clough ..... B65D 39/16 215/300
2,220,580 A * 11/1940 Penn ..... B65D 39/16 215/364

(Continued)

OTHER PUBLICATIONS

Aragone, Claudia (EP Authorized Officer), International Search Report and Written Opinion of the International Searching Authority, dated Aug. 7, 2018, in corresponding International Application No. PCT/IB2018/052769, 14 pages.

*Primary Examiner* — J. Gregory Pickett
*Assistant Examiner* — Brijesh V. Patel
(74) *Attorney, Agent, or Firm* — MH2 Technology Law Group LLP

(57) ABSTRACT

A closure comprises a cylindrical element (1, 101) having a first portion (2, 102) and a second portion (3, 103), the latter being adapted to engage, as a removable cap, in a portion of a neck (5) of a container, an overcap (8, 108) attached to the cylindrical element (1, 101), comprising a first body (9, 109, 209) and a second body (15, 115, 215), attached together and defining a seat (19, 219). The cylindrical element (1, 101) is partially disposed in the seat (19, 219) to be locked within the seat (19, 219).

21 Claims, 6 Drawing Sheets

(58) Field of Classification Search
USPC ..... 215/364, 300, 354–355, 249, 296, 247, 215/261, 294, 305, 320, 43, DIG. 3; 220/352; 222/563
See application file for complete search history.

(56) References Cited

U.S. PATENT DOCUMENTS 2,249,022 A * 7/1941 Merolle ..... B65D 39/16 215/364
2,641,375 A * 6/1953 Steuart ..... B65D 39/16 215/364
3,559,834 A * 2/1971 Taylor ..... B65D 39/0058 215/261
3,604,593 A * 9/1971 Curci ..... B65D 55/02 221/288
4,106,656 A 8/1978 Babiol
4,271,972 A 6/1981 Thor
4,394,922 A * 7/1983 Wimmer ..... B65D 39/16 215/300
4,995,521 A * 2/1991 von Schuckmann ..... B65D 51/002 215/249
5,133,472 A 7/1992 Koda et al.
5,718,348 A * 2/1998 Manera ..... B65D 41/28 215/249
5,803,285 A * 9/1998 Hirota ..... B65D 39/16 215/296
5,884,789 A 3/1999 Gardner
7,125,187 B2 * 10/2006 Osti ..... B65D 23/00 401/128
9,114,912 B2 * 8/2015 Giovannini ..... B65D 39/16
2015/0060389 A1 * 3/2015 Bolger ..... B65D 55/00 215/355
2019/0283944 A1 * 9/2019 Giovannini ..... B65D 39/0052

* cited by examiner

STOPPERS WITH OVERCAPS FOR CONTAINERS

CROSS-REFERENCE TO RELATED APPLICATION(S)

This application is a national stage entry from International Application No. PCT/IB2018/052769, filed on Apr. 20, 2018, in the Receiving Office ("RO/IB") of the International Bureau of the World Intellectual Property Organization ("WIPO"), and published as International Publication No. WO 2018/193422 A1 on Oct. 25, 2018; International Application No. PCT/IB2018/052769 claims priority from Italian Patent Application No. 102017000044485, filed on Apr. 21, 2017, in the Italian Patent and Trademark Office ("IPTO"), and also claims priority from Italian Patent Application No. 102017000044489, filed on Apr. 21, 2017, in the IPTO, the entire contents of all of which are incorporated herein by reference.

The present disclosure relates to a closure for containers, preferably bottles, comprising a body and a neck extending from the body with an opening at the free end thereof, said closure comprising a cylindrical element having a first portion and a second portion, the latter being adapted to engage, as a removable cap, in a portion of said neck through said opening and an overcap, axially associated with the first portion of said cylindrical element.

Closures of this type are known in the art and are particularly used to close bottles containing beverages that are rarely counterfeited or possibly containing valuable alcoholic beverages that are sold in protected areas, in which closures are not required to use tamperproof means.

In these closures, connection between the cylindrical element that acts as a cap, which is usually made of cork or another valuable material that is suitable for cap, to be introduced into and removed from the bottle neck, and the overcap which is conventionally made of wood or molded from plastic material and is possibly covered by an additional metal overcap, which is used to move the aforementioned cylindrical element, is known to require good stability and resistance to stresses in the axial direction and to torque about the longitudinal axis.

In accordance with the prior art, the aforementioned connection is obtained by providing an overcap, typically made of one piece or two pieces, and having a circular or polygonal shape, whose thickness is adapted to afford an adequate manual grip thereon, in which a recess is formed with a generally circular section, such as the section of the cylindrical element that acts as a cap.

The end of the aforementioned cylindrical element to be connected to the overcap is introduced into the recess and the connection is obtained by pressing the contact surfaces together with adhesives interposed therebetween.

Nevertheless, while adhesives may be effective in connecting the parts and ensuring that connection is maintained throughout the life of the container, they cause a considerable drawback, in that there is no way of eliminating the unpleasant smells released by common adhesives, which obviously hinder the perception of the fragrance of the beverage in the bottle when the closure is removed from the container.

Therefore, the object of the present disclosure is to provide a closure as described hereinabove, which can ensure a resistant, durable connection between the cylindrical element made of cork or a valuable material, which is adapted to act as a cap, and the operating overcap, without using adhesives.

Several embodiments of the present invention will be now described in greater detail with reference to certain preferred embodiments, given by way of illustration and without limitation, and shown in the annexed drawings, in which.

Figure 4:
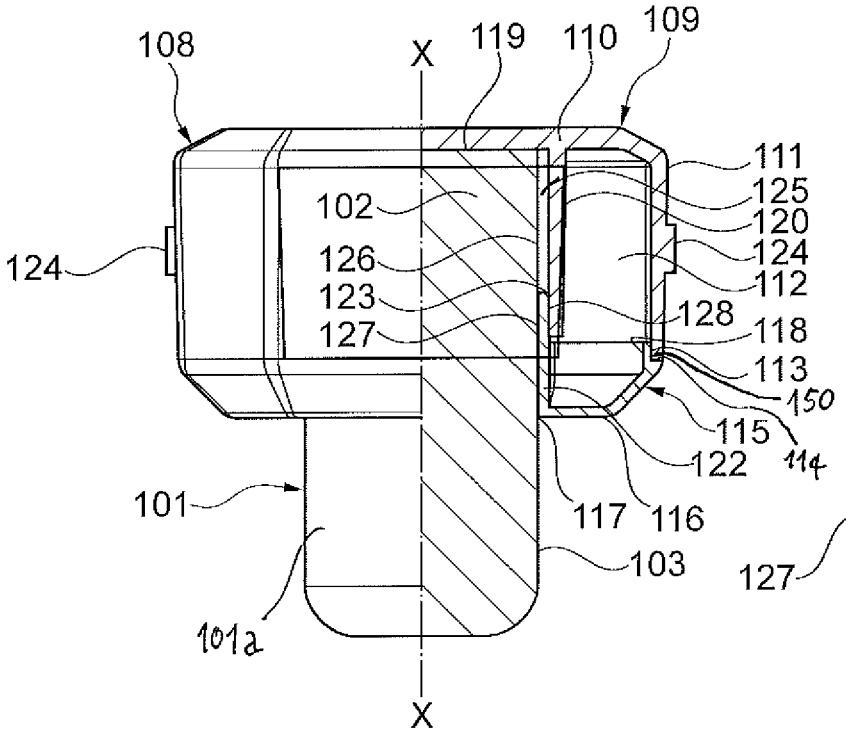
FIG. 4 shows a side view of the closure according to a second embodiment of the invention, as viewed partially as a vertical section.
Figure 4A:
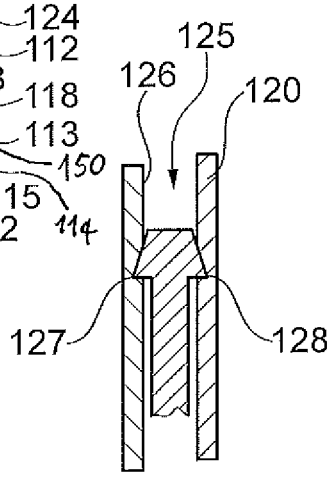
Figure 5:
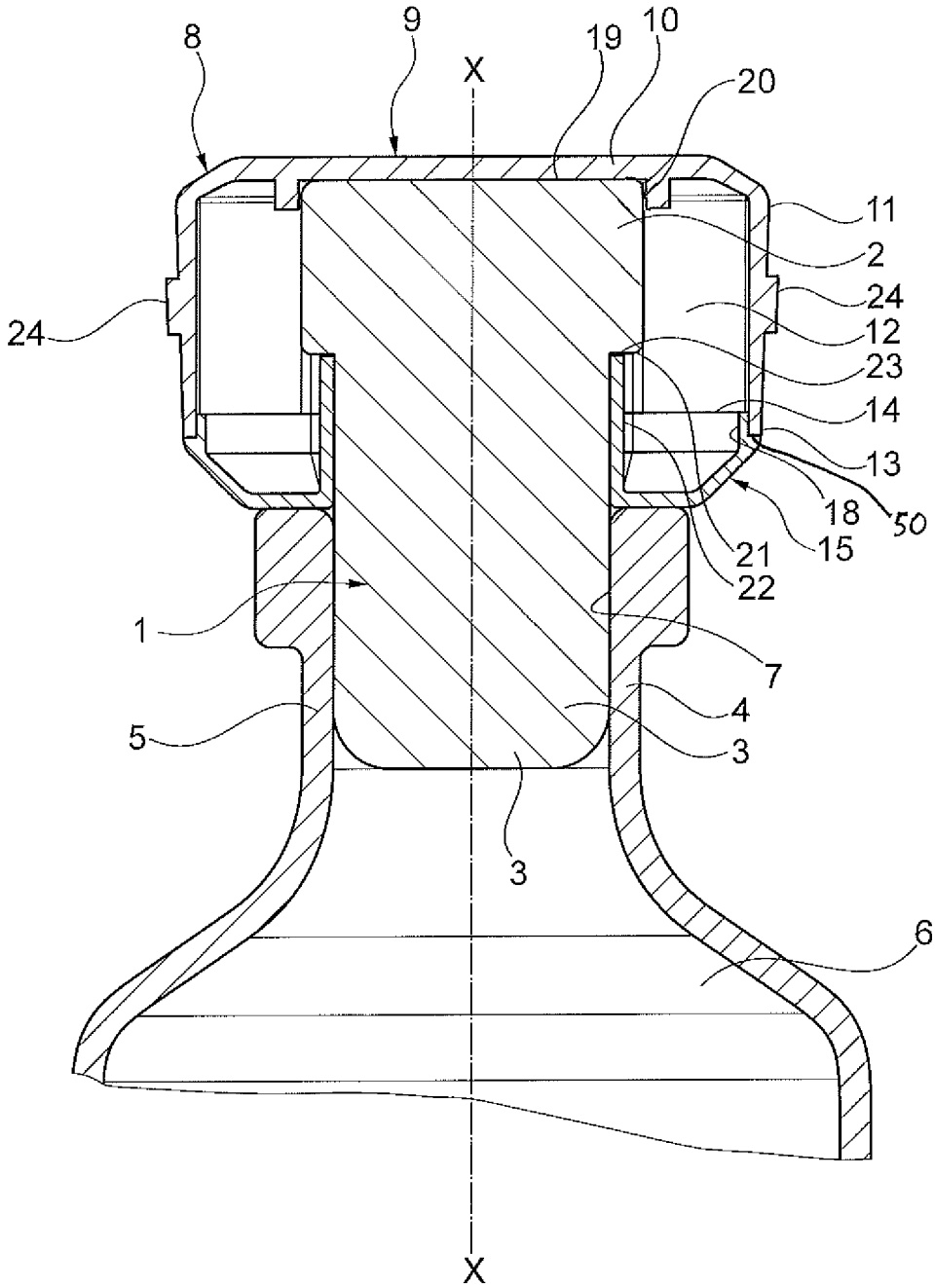
Figure 6:
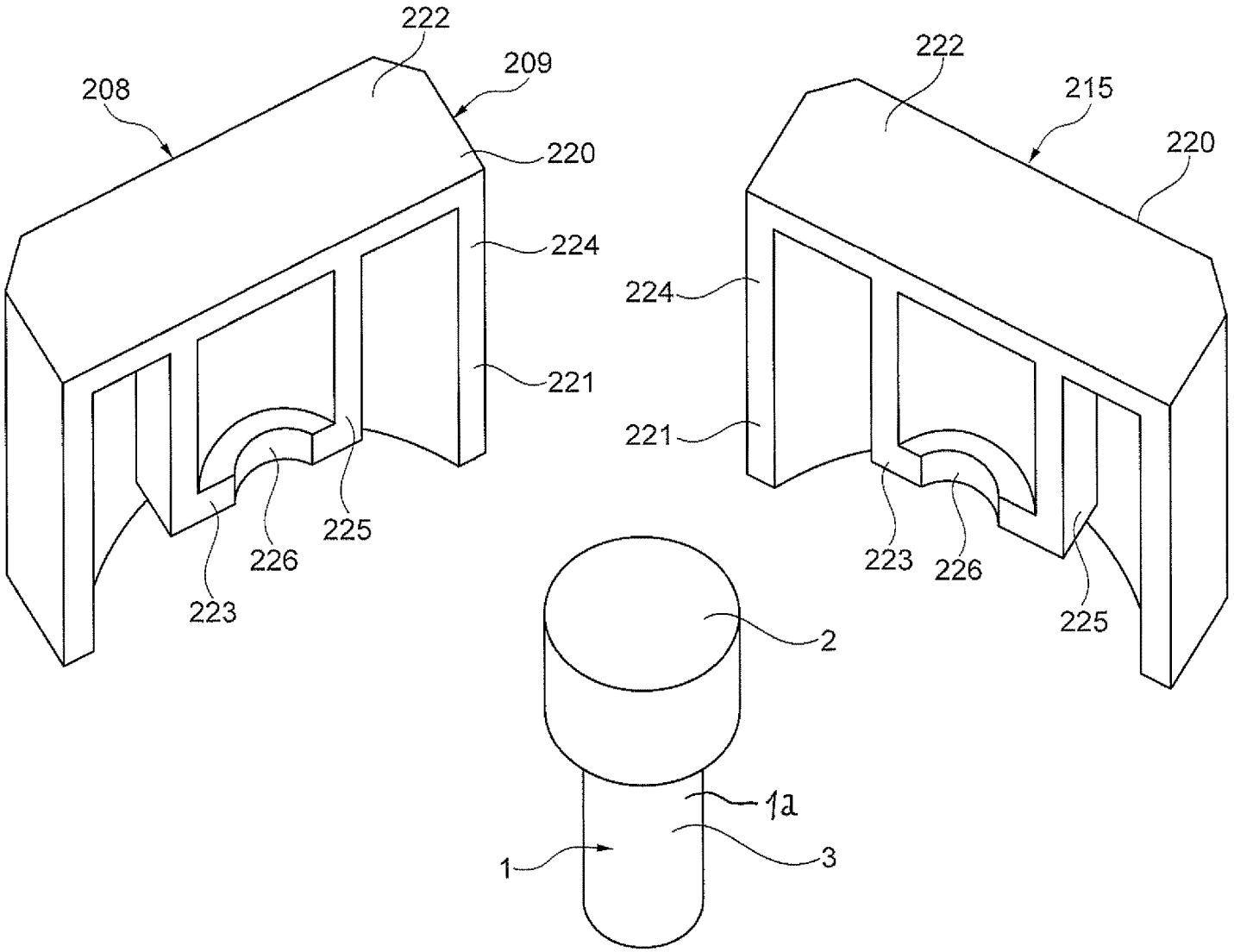
Figure 7:
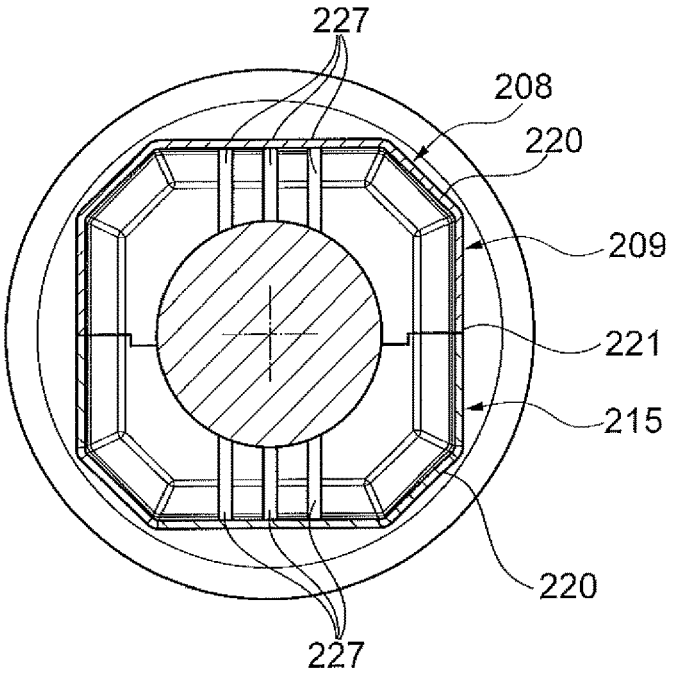
Figure 8:
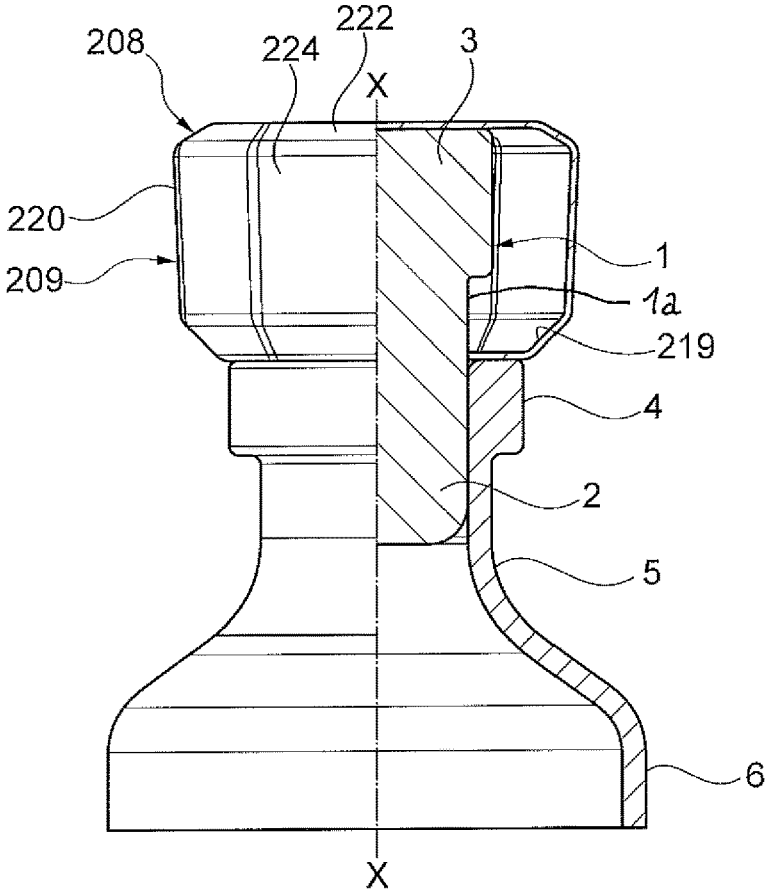

FIG. 4*a* shows a detail of FIG. 4;

FIG. 5 shows a sectional view of the closure applied to the neck of container, in the form of a bottle;

FIG. 6 is an exploded perspective view of a third embodiment of the closure of the invention;

FIG. 7 is a top sectional view of a fourth embodiment of the closure of the invention;

FIG. 8 is partially sectional front view of the closure of FIG. 7; and

Figure 9:
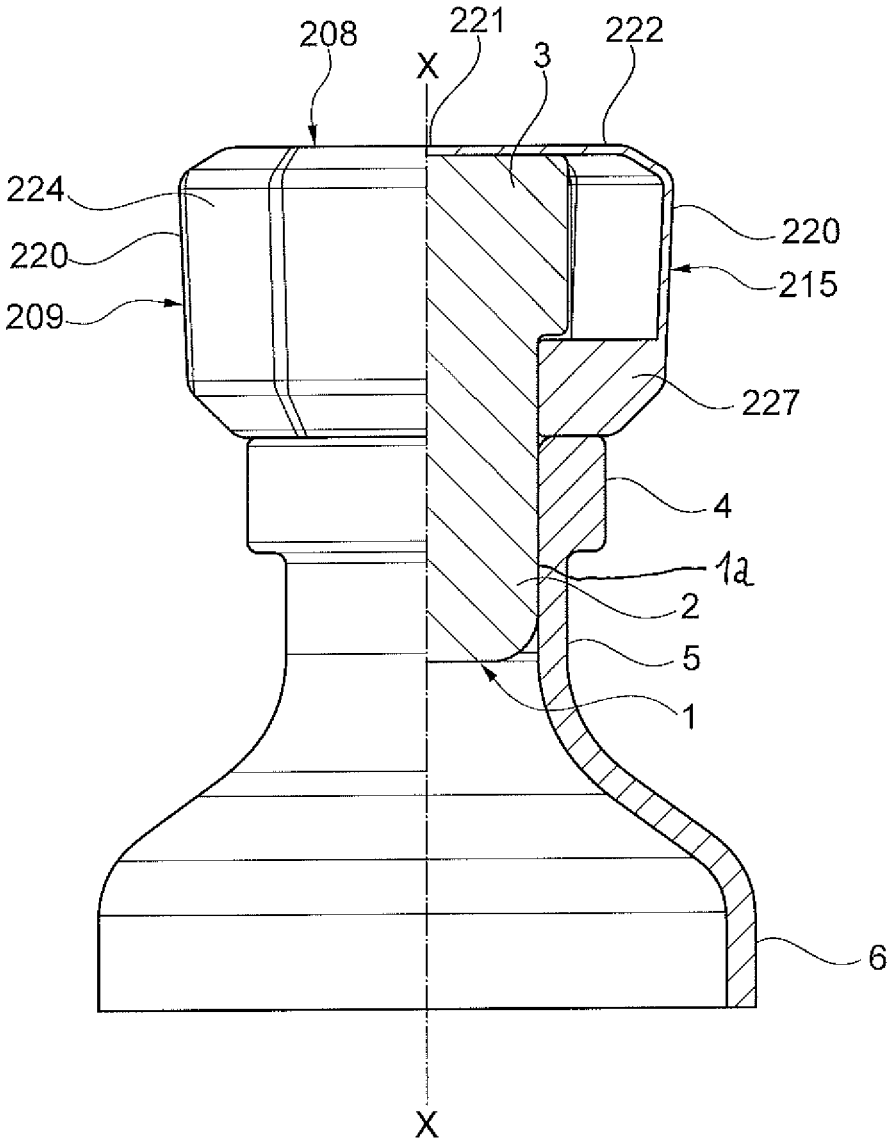

FIG. 9 is partially sectional side view of the closure of FIGS. 7 and 8.

Referring to the accompanying figures, a closure for containers in the form of a bottle will be now described. These containers comprise a body 6 and a neck 5. The neck 5 extends from the body 6 and has an opening 7 at one free end 4 thereof.

Particularly, the closure comprises a cylindrical element 1 having a first portion 2 and a second portion 3. The second portion 3 is adapted to engage within a portion of the neck 5 through the opening 7, to thereby act as a removable cap. The first portion 2 and the second portion 3 are rigidly joined to each other and extend axially along an axis X-X of the closure.

As used herein, the term "cylindrical element" is intended to designate a element that is generally axially symmetric and, in some of the embodiments that will be described hereinafter, has a cylindrical shape.

An overcap 8 is fixed to the cylindrical element 1. The overcap 8 comprises a first body 9 and a second body 15. Such first body 9 and second body 15 are fixed to each other and define a seat 19. The aforementioned cylindrical element 1 is partially placed in this seat 19 such that it is locked inside the seat 19.

The first body 9 and the second body 15 are connected to each other. Advantageously, the mutual fixation of the first body 9 and the second body 15 may be obtained by welding, interference fit, screw connection or gluing.

Particularly referring to FIGS. 1, 2, 3 and 5, a first embodiment of the closure comprises the aforementioned cylindrical element 1. The overcap 8 is axially associated with the first portion 2 of said cylindrical element 1 for manually operating the portion 3 that acts as a cap.

Figure 3:
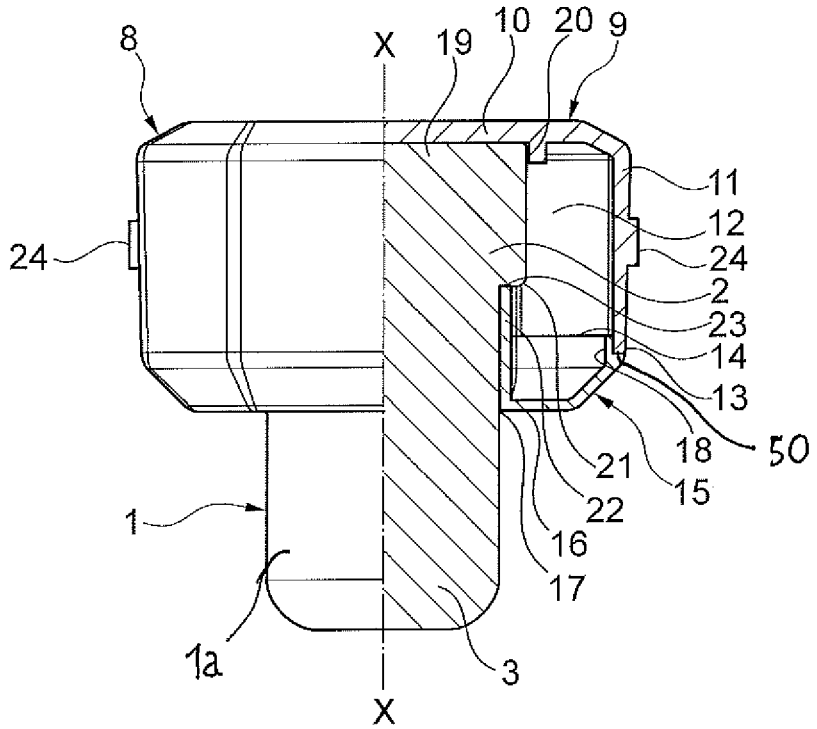
FIG. 3 shows a side view of the closure according to a first embodiment of the invention, as viewed partially from the side and partially as a vertical section.

As shown in FIG. 3, the first body 9 consists of a first flat element 10. A side wall 11 is rigidly joined to the contour of said first flat element 10 and axially extends therefrom perpendicular to the flat element, thereby forming a cavity 12 therebetween. The free edge 13 of said side wall 11 forms an opening 14, 114 for the cavity 12.

The second body 15 in turn consists of a second flat element 16 having a central opening 17. The second body 15 has a contour 18, the latter being adapted to engage with the free edge 13 of the side wall 11 of the first body 9 and acting as a closing bottom.

It shall be noted that the first 9 and second 15 bodies define an engagement zone 50 at the free edge 13 and the contour 18. This engagement zone 50 is radially spaced and disengaged from the cylindrical element 1.

The first portion 2 of the cylindrical element 1 of the closure, is placed in said cavity 12 of the overcap 8 and is rigidly joined to the first flat element 10 of the first body 9, after passing through the central opening 17 of the second flat element 16 of the second body 15.

According to the first embodiment, as shown in FIG. 3, the free edge 13 of said side wall 11, which is rigidly joined to said first flat element 10, has snap engagement means for connection with corresponding means formed in the contour 18 of the second flat element 16, to thereby close the cavity 12 and form the overcap 8. In other words, in this embodiment, the first body 9 and second 15 body are connected by interference fit. Alternatively, the first body 9 and second 15 body may have threads and may be fixed to each other by screw engagement.

It shall be noted that, in the embodiment of FIG. 3, the aforementioned seat 19 laterally retains the portion 2 by means of an edge 20, that projects out of the flat element 10 toward the cavity 12 that surrounds the contour, of the portion 2, which preferably has a circular shape.

The portion 2 of the cylindrical element 1, in the embodiment of FIG. 3, has a greater cross section than the portion 3 of the same cylindrical element 1, which determines an annular abutment 21 between the two sections.

The central opening 17 of the second flat element 16 of the second body 15 of the overcap 8 has a collar 22 that is rigidly joined to said second flat element 16 and extends toward said cavity 12. This collar 22 surrounds and creates an interference fit with an outer wall 1*a* of the cylindrical element 1.

The free edge 23 of said collar 22, when the overcap 8 is formed as a result of the coupling of the first body 9 with the second body 15, is frontally engaged with the annular abutment 21, which affords stable positioning of the cylindrical element 1 with respect to the overcap 8.

It shall be understood that, in order to improve a torsional connection of the element 1 and the overcap 8, the mutually contacting cylindrical surfaces on the edge 20 and the collar 22 may be broached, or generally have mutually engaging teeth and axial grooves, not shown as they are deemed to be well known in the art.

Figure 1:
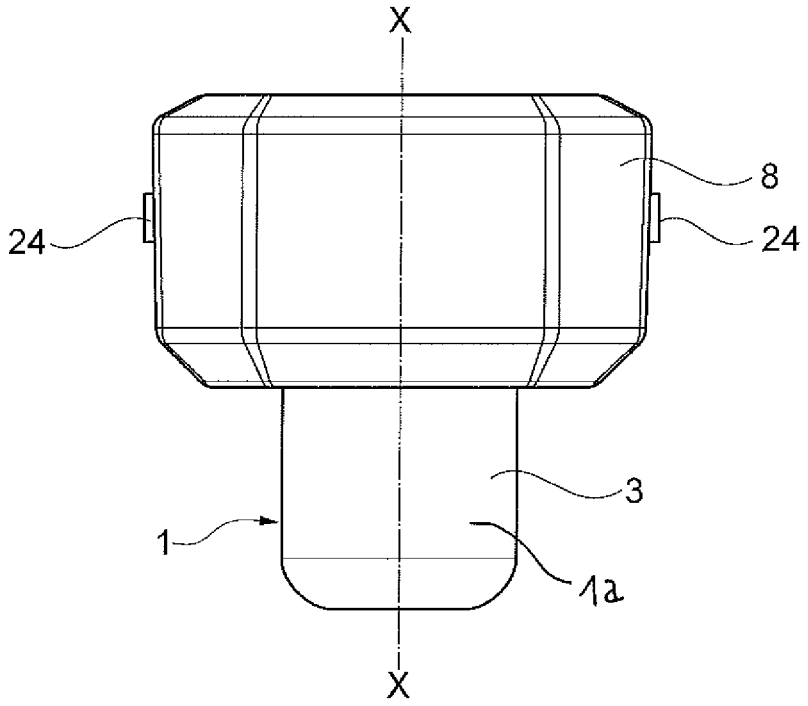
FIG. 1 is a side view of the closure.
Figure 2:
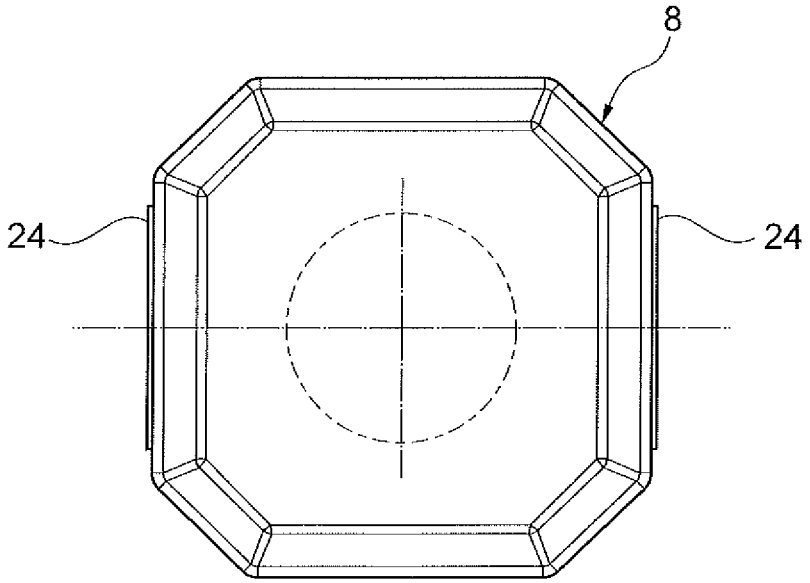
FIG. 2 shows a top view of the closure of FIG. 1.

In order to improve the manual grip on the overcap, the side wall 11 of its first body 9 may have a rib 24, 124 on at least a part of its outer surface, and its peripheral configuration may be advantageously polygonal, as shown in FIG. 2.

Referring to FIG. 4, a second embodiment of the closure will be now described using the reference numerals that were used in the first embodiment incremented by 100, to designate equivalent structural parts.

It will be appreciated that once again, in the second embodiment, the overcap 108 is composed of a first body 109 and a second body 115 which are connected by snap engagement at the edge 113 of the side wall 111 that is rigidly joined to the first flat element 110 and the edge 118 of the second flat element 116 of the second body 115 that acts as a closing bottom of the overcap 108 also in this second embodiment.

Similarly to what has been described above with reference to the first embodiment, also in this case the engagement zone 150 is radially spaced and disengaged from the cylindrical element 101.

Unlike the first embodiment, the cylindrical element 101, in its first portion 102 situated inside the overcap 108, has a circular section that has the same size as the one of the second portion 103 performing that acts as a cap when it fits in the neck of the container, in the form of a bottle. Advantageously, in this embodiment the cost of the cylindrical element 101 is reduced. Furthermore, standard cylindrical elements may be used, without necessarily using a specially designed cork.

According to the above discussed second embodiment, the edge 120 that perpendicularly projects from the first flat element 110 toward the interior of the cavity 112, extends coaxial with the portion 102 within the seat 119, but is radially spaced apart from such portion 102, thereby forming an annular gap 125. This edge 120 axially extends to proximity of the second flat element 116 of the second body 115 thereby assuming the shape of a sleeve.

In the second embodiment, the second flat element 116 of the second body 115, has a central opening 117 through which the cylindrical element 101 extends to be placed in the cavity 112 by its portion 102.

On the opening 117, the second flat element 116 has a collar 122. Particularly, the collar 122 surrounds and creates an interference fit with an outer wall 101*a* of the cylindrical element 101. More in detail, this collar 122, which axially extends toward the cavity 112, is disposed in the annular gap 125 formed between the sleeve 120 and the opposing surface 126 of the portion 102 of the cylindrical element 101 and is locked by the friction that the collar 122 creates with the surface of the sleeve 120 and with the opposing surface 126 of the portion 102 of the cylindrical element 101.

In order to increase the friction between the facing surfaces that form the annular gap 125, the end 123 of said collar 122 has opposed sharp protubera.nces 127, 128 which engage with the opposing surface 126 of the first portion 102 of the cylindrical element 101 and with the sleeve 120 respectively, thereby affording positioning and stable axial and torsional connection of said cylindrical element 101 and its overcap 108, only using mechanical means during mounting of the overcap 108. Like in the first embodiment, the first body 109 and the second body 115 are connected by interference fit.

Referring to FIG. 6, a third embodiment will be now described. Particularly, like in the embodiment of FIG. 3, the first portion 2 of the cylindrical element 1 has a greater width than the second portion 3.

Concerning the overcap 208, it shall be noted that the first body 209 and the second body 215 are each defined by a respective half-part 220. These half-parts 220 have a contact edge 221 that at least partially lies on a plane containing the axis X-X of the closure. These half-parts 220 are joined at their respective contact edges 221, to thereby define the aforementioned overcap 208.

According to one embodiment, the half-parts 220 are identical. Alternatively, the half-parts 220 may be distinct from each other and also have complex shapes, e.g. human heads or animals, anthropomorphic forms or other complex geometries. It shall be noted that the contact edges 221 of the half-parts 220 are welded together, preferably by ultrasonic welding. Alternatively, the contact edges 221 may be bonded together in any manner that is known to the skilled person, e.g. by heat sealing.

More in detail, each half-part 220 comprises a top wall 222, a bottom wall 223, an outer side wall 224, and an inner side wall 225. Preferably, the walls 222, 223, 224 and 225 have a uniform thickness.

The top 222 and bottom 223 walls are arranged transverse and particularly perpendicular to the axis X-X of the closure. In addition, the top 222 and bottom 223 walls are flat and particularly parallel to each other. These top 222 and bottom 223 walls have a semicircular plan, and their centers are placed along the axis X-X of the closure. The bottom wall 223 further has a hole 226. This hole has a semicircular shape and has its center on the axis X-X of the closure.

It shall be noted that the terms "top" and "bottom" should be understood as describing the mutual arrangement of the walls not in an absolute sense, but only in a condition of use in which the axis X-X of the closure is substantially vertically oriented and the closure is oriented with the top wall 222 on top, like in the accompanying figures.

According to a preferred embodiment, the outer 224 and inner 225 side walls both extend from the top wall 222. The side walls 224, 225 face each other and are preferably parallel. More in detail, the side walls 224, 225 have a semi-cylindrical shape and are coaxial with each other. The outer side wall 224 extends from the edge of the top wall 222. The inner side wall 225 joins the edge of the bottom wall 223 to the top wall 222.

Particularly referring to seat 219, it shall be noted that in the embodiment of FIG. 6, its shape mates the shape of the first portion 2 of the cylindrical element 1, to lock the first portion 2 along the axis X-X of the closure when the two half-parts 220 are joined together.

More in detail, the seat 219 is defined by the top wall 222, the bottom wall 223 and the inner side wall 225. Preferably the seat 219 has a non-slip finish on one or more surfaces, to thereby prevent the cylindrical element 1 from rotating therein.

The hole 226, which opens on the seat 219, has the second portion 3 of the cylindrical element 1 extending therethrough. Particularly, the hole 226 has the same diameter as the second portion 3 of the cylindrical element 1. The inner side wall 225 has an inside diameter that is substantially equal to the diameter of the first portion 2 of the cylindrical element 1.

FIGS. 7 to 9 show a fourth embodiment. This embodiment is very similar to the embodiment of FIG. 6. Nevertheless, unlike the latter, the inner side wall 225 and the bottom wall 223 are not provided. Accordingly, the above described seat 219 will be defined by the top wall 222 and the outer side wall 224. Here, in order to firmly hold the cylindrical element 1, 101 the seat 219 will be formed with a plurality of ribs 227 for this purpose. These ribs 227 are preferably evenly arranged on the half-parts 220 and extend from the outer side wall 224 toward the interior of the seat 219. More in detail, any number of ribs may be provided. Furthermore, the ribs 227 can be parallel, as shown for example in FIG. 7 or, according to a variant embodiment, not shown, may be radially arranged relative to the axis X-X of the closure.

Finally, it should be noted that, according to a variant embodiment, not shown, in this case the cylindrical element 1, 101 may have a constant diameter along the axis X-X of the closure.

The invention claimed is:

1. A closure for a container, the container comprising a body and a neck extending from the body, the container having an opening at a free end of the neck, the closure comprising:

a cylindrical element having a first portion and a second portion, wherein the second portion is configured to engage, as a removable cap, into a portion of the neck through the opening; and an overcap attached to the cylindrical element, comprising a first body and a second body, attached together and defining a seat;

wherein the cylindrical element is partially in the seat to be locked within the seat, wherein the first body comprises a first flat element with a side wall which is rigidly joined to a contour of the first flat element and extends axially therefrom, perpendicular to the first flat element, thereby forming a cavity therebetween, a free edge of the side wall forming an opening for the cavity, wherein one end of the first portion of the cylindrical element is inserted in the seat, the seat laterally confining such end, wherein the seat in which the first portion of the cylindrical element is axially accommodated has a sleeve axially extending within the cavity of the overcap, perpendicular to the first flat element of the first body of the overcap, wherein a central opening of a second flat element of the second body of the overcap has a collar that axially extends toward the cavity of the overcap, and wherein a free end of the collar is configured to frictionally fit between the first portion of the cylindrical element accommodated in the seat and the sleeve that encircles the seat, thereby creating a stable connection between the cylindrical element and the overcap.

2. The closure of claim 1, wherein the second body comprises the second flat element having the central opening, wherein the second flat element has a contour configured to engage with the free edge of the side wall of the first body, wherein an engagement zone is defined between the first body and the second body at the free edge of the side wall of the first body and at the contour of the second flat element, and wherein the engagement zone is radially spaced apart and disengaged from the cylindrical element.

3. The closure of claim 2, wherein the free edge of the side wall that is rigidly joined to the contour of the first flat element has means for attachment to corresponding means formed in the contour of the second flat element of the second body of the overcap.

4. The closure of claim 1, wherein the central opening of the second flat element of the second body has a collar rigidly joined to the second flat element, which extends toward the cavity and surrounds and creates an interference fit with an outer wall of the cylindrical element.

5. The closure of claim 1, wherein the first portion of the cylindrical element of the closure is in the cavity and rigidly joined to the first flat element of the first body, passing through the central opening of the second flat element of the second body.

6. The closure of claim 1, wherein the free end of the collar has opposed protuberances which engage with a surface of the first or second portion of the cylindrical element and with the sleeve respectively, thereby affording positioning and stable axial and torsional connection of the cylindrical element and the overcap.

7. The closure of claim 1, wherein the first portion of the cylindrical element, the seat formed in the first flat element of the first body of the overcap, and the central opening in the second flat element of the second body of the overcap have a circular contour.

8. The closure of claim 1, wherein the first body and the second body are connected by snap engagement.

9. The closure of claim 1, wherein the first flat element and the second flat element are connected by snap engagement.

10. The closure of claim 1, wherein the first body and the second body are connected by interference fit.

11. The closure of claim 1, wherein the first flat element and the second flat element are connected by interference fit.

12. The closure of claim 1, wherein the first portion of the cylindrical element has a same cross-section as the second portion of the cylindrical element.

13. The closure of claim 1, wherein the first portion of the cylindrical element has a same diameter as the second portion of the cylindrical element.

14. The closure of claim 1, wherein the first portion of the cylindrical element has a same diameter as the central opening of the second flat element of the second body.

15. The closure of claim 1, wherein the second portion of the cylindrical element has a same diameter as the central opening of the second flat element of the second body.

16. The closure of claim 1, wherein the free end of the collar has opposed protuberances which engage with a surface of the first or second portion of the cylindrical element and with the sleeve respectively, thereby affording positioning of the cylindrical element and the overcap.

17. The closure of claim 1, wherein the free end of the collar has opposed protuberances which engage with a surface of the first or second portion of the cylindrical element and with the sleeve respectively, thereby affording stable axial connection of the cylindrical element and the overcap.

18. The closure of claim 1, wherein the free end of the collar has opposed protuberances which engage with a surface of the first or second portion of the cylindrical element and with the sleeve respectively, thereby affording stable torsional connection of the cylindrical element and the overcap.

19. The closure of claim 1, wherein the sleeve is radially spaced apart from the first portion of the cylindrical element, thereby forming an annular gap between the sleeve and the first portion of the cylindrical element.

20. The closure of claim 1, wherein the first body is coaxial with the second body.

21. The closure of claim 1, wherein the first flat element is coaxial with the second flat element.

* * * * *